US006705878B2

(12) United States Patent
Liang

(10) Patent No.: US 6,705,878 B2
(45) Date of Patent: Mar. 16, 2004

(54) PORTABLE UNIVERSAL COUPLER FOR COMPUTER FACILITY

(75) Inventor: Hsieh Rong Liang, Fremont, CA (US)

(73) Assignee: Atech Flash Technology, Inc., Fremont, CA (US)

( * ) Notice: Subject to any disclaimer, the term of this patent is extended or adjusted under 35 U.S.C. 154(b) by 0 days.

(21) Appl. No.: 10/212,592

(22) Filed: Aug. 6, 2002

(65) Prior Publication Data

US 2004/0029416 A1 Feb. 12, 2004

(51) Int. Cl.[7] ..... H01R 9/09

(52) U.S. Cl. ..... 439/76.1; 361/752

(58) Field of Search ..... 439/76.1, 41, 528, 439/105, 502; 361/682, 707, 384, 391, 695, 724, 752, 736, 728, 730, 796

(56) References Cited

U.S. PATENT DOCUMENTS 5,444,601 A * 8/1995 Honda et al. ..... 361/683
6,050,848 A 4/2000 Yao ..... 439/483
6,542,445 B2 * 4/2003 Ijichi et al. ..... 369/30.08

* cited by examiner

*Primary Examiner*—Gary Paumen
*Assistant Examiner*—Phuongchi Nguyen
(74) *Attorney, Agent, or Firm*—Troxell Law Office PLLC

(57) ABSTRACT

A universal coupler device includes a housing for coupling to various computer facilities, a circuit board received in the housing, two IEEE couplers and two USB couplers attached to the circuit board, one or more processor devices coupled to the IEEE couplers and the USB couplers, and a coupling box having a coupler element for detachably coupling to a coupler member of the circuit board and having one or more sockets for plugging various card members, and for allowing various card members to be coupled to the computer facility with the coupling box.

7 Claims, 6 Drawing Sheets

PORTABLE UNIVERSAL COUPLER FOR COMPUTER FACILITY

BACKGROUND OF THE INVENTION

1. Field of the Invention

The present invention relates to a universal coupler, and more particularly to a portable universal coupler combination for computer facilities.

2. Description of the Prior Art

Typical card readers are provided for receiving or plugging various kinds of cards, and are each designed for receiving a predetermined card only, such that the cards may not be plugged to different card readers. In addition, the card readers are required to be coupled to the computer facilities with a coupling cable or the like, such that the card readers may not be easily coupled to the other computer facilities while the card readers are carried to the other places. Furthermore, the typical card readers may each be coupled to a predetermined machine, such as the fax machine, the printer, etc., and may not be coupled to different machines.

The present invention has arisen to mitigate and/or obviate the afore-described disadvantages of the conventional universal couplers.

SUMMARY OF THE INVENTION

The primary objective of the present invention is to provide a universal coupler combination for plugging various kinds of cards.

The other objective of the present invention is to provide a universal coupler combination for allowing various kinds of cards to be coupled to the computer facilities without additional coupling cables.

The further objective of the present invention is to provide a universal coupler combination for plugging or coupling to various kinds of peripheral or output facilities.

The still further objective of the present invention is to provide a universal coupler combination which is portable for plugging or coupling to the other computer facilities or machines.

In accordance with one aspect of the invention, there is provided a universal coupler combination for coupling to computer facilities and comprising a housing for coupling to the computer facility, a circuit board received in the housing, and including a front portion and a rear portion each having an IEEE coupler and a USB coupler attached thereon, and including a first coupler provided thereon, and including at least one processor device provided thereon and coupled to the IEEE couplers and the USB couplers and the first coupler, and a coupling box including a rear portion having a second coupler provided thereon, for detachably coupling to the first coupler of the circuit board, and including a front portion having at least one socket provided therein for receiving and plugging card members, such that various kinds of cards may be coupled or plugged to the computer facility with the coupling box only. The coupling box may also be detached or disengaged from the computer facility for coupling to various kinds of peripheral or output devices.

The circuit board includes an opening formed therein for receiving the rear portion of the coupling box. The housing includes a front portion, and a cap attached to the front portion thereof, the cap includes a groove formed therein and aligned with the opening of the circuit board for receiving the rear portion of the coupling box.

The cap includes a first aperture formed therein and aligned with the IEEE coupler for receiving the IEEE coupler, and includes a second aperture formed therein and aligned with the USB coupler for receiving the USB coupler.

The circuit board includes a third coupler provided thereon and having at least one row of pins provided thereon, for coupling to the other facilities or devices.

The housing includes a rear portion having a first and a second orifices formed therein and aligned with the IEEE coupler and the USB coupler respectively for receiving the IEEE coupler and USB coupler respectively.

The housing includes a base, and a cover secured on the base, the base includes a plurality of studs extended therein, and the circuit board is secured on the studs of the base.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
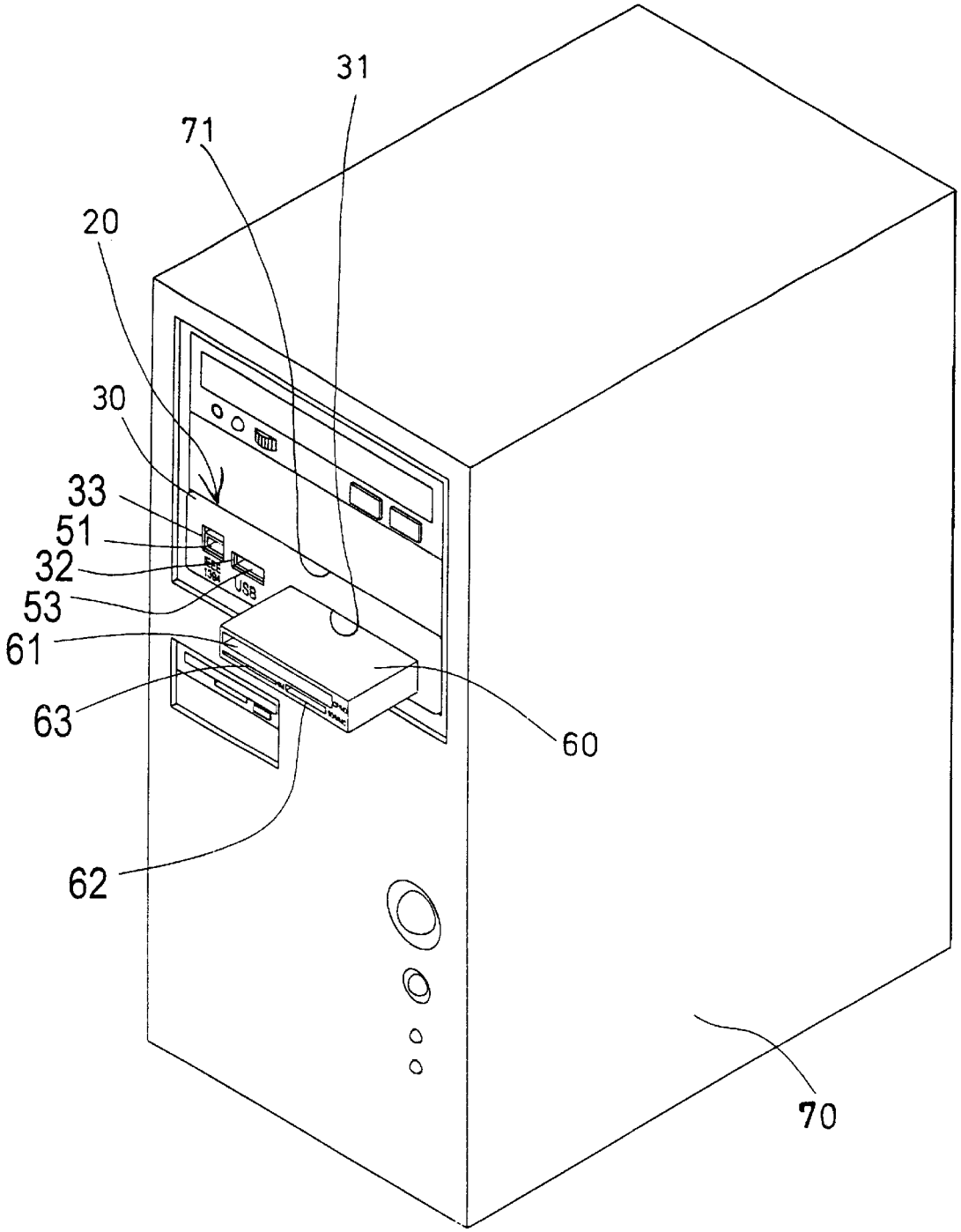
FIG. 1 is a perspective view of a computer facility having a universal coupler combination in accordance with the present invention.
Figure 2:
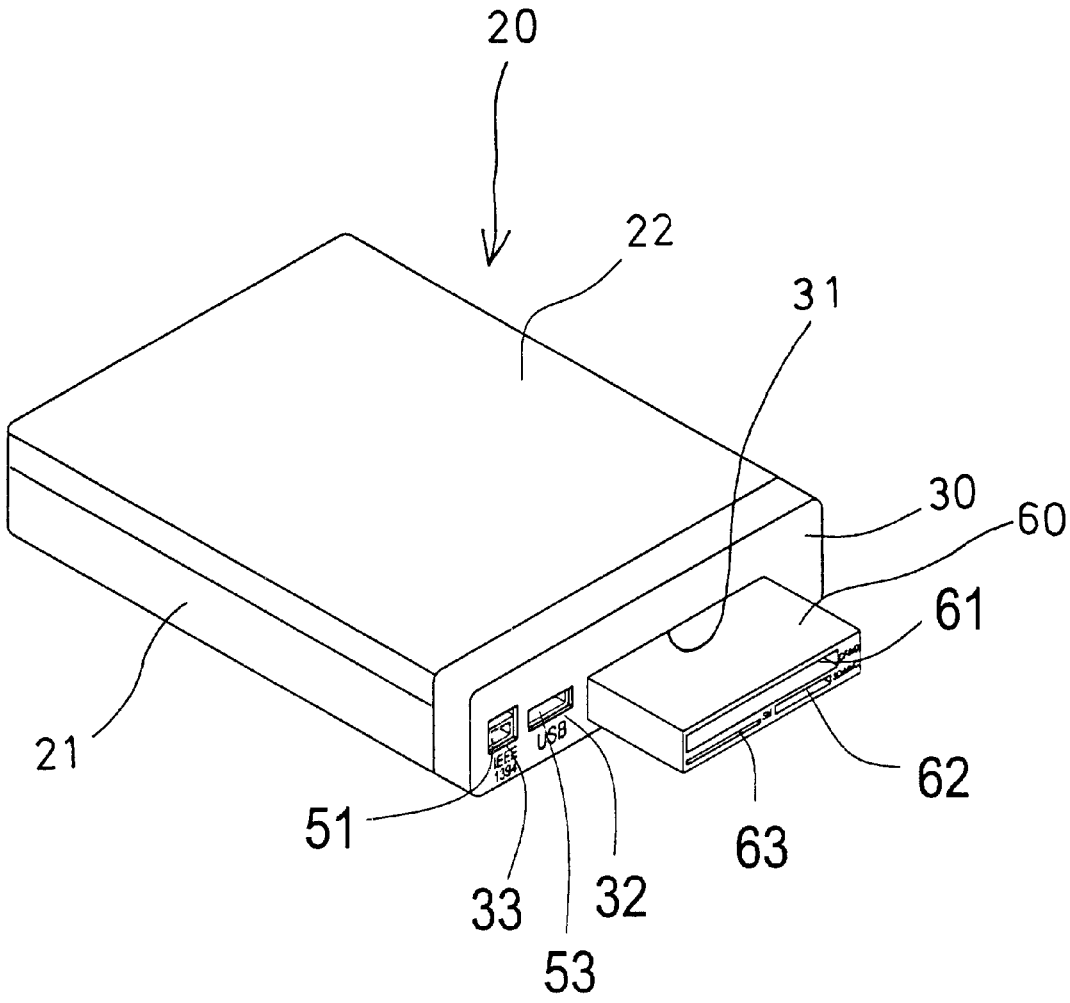
FIG. 2 is a perspective view of the universal coupler combination.
Figure 3:
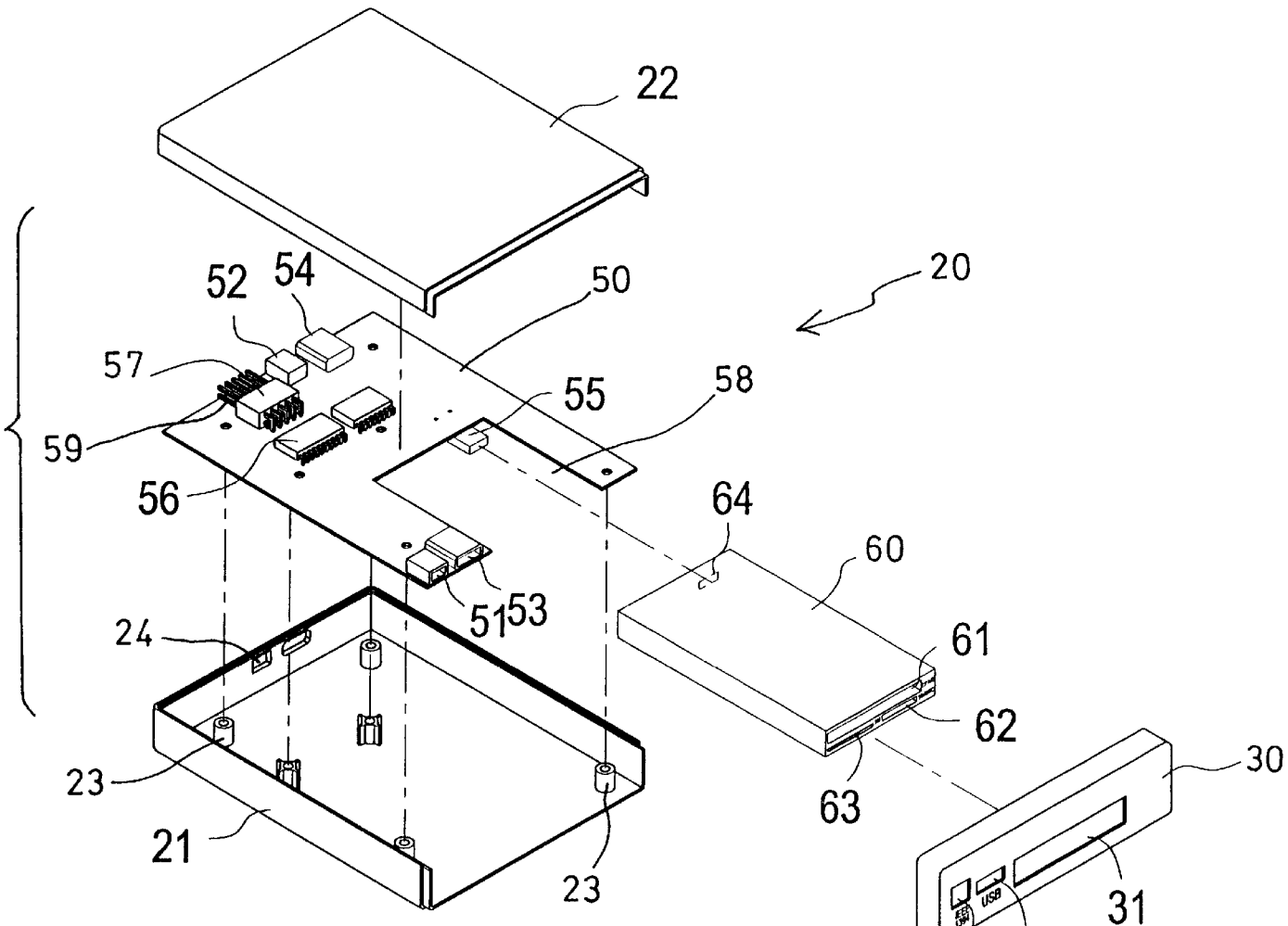
FIG. 3 is an exploded view of the universal coupler combination.

Referring to the drawings, and initially to FIGS. 1–3, a universal coupler combination in accordance with the present invention comprises a housing 20 for coupling or plugging into a channel 71 of a computer facility 70 or the like, and including a base 21 and a cover 22 secured together with fasteners or the like. The base 21 includes a number of studs 23 extended or provided therein for supporting and securing a circuit board 50 in the housing 20.

The circuit board 50 may be a printed circuit board or the like, and includes a pair of plugs or couplers 51, 52 of institute of electrical and electronics engineers (IEEE) 1394, for example, attached to the front and the rear portions of the circuit board 50 respectively, another pair of plugs or couplers, such as the universal serial bus (USB) couplers 53, 54 also attached to the front and the rear portions of the circuit board 50 respectively, and includes a notch or an opening 58 formed therein, such as formed in the front portion thereof for receiving a coupling box 60.

The circuit board 50 includes a plug or a coupler 55 attached to the middle portion thereof and preferably extended inward of the opening 58 thereof for plugging or coupling to the coupling box 60. Another plug or coupler 57 may further be provided and disposed on the circuit board 50 and includes one or more rows of coupler pins 59 extended therefrom for coupling to various kinds of computer facilities or the like. The circuit board 50 includes one or more micro-processors or the other processor devices 56 disposed thereon and coupled to the IEEE couplers 51, 52, the USB couplers 53, 54, and the other couplers 55, 57.

Figure 4:
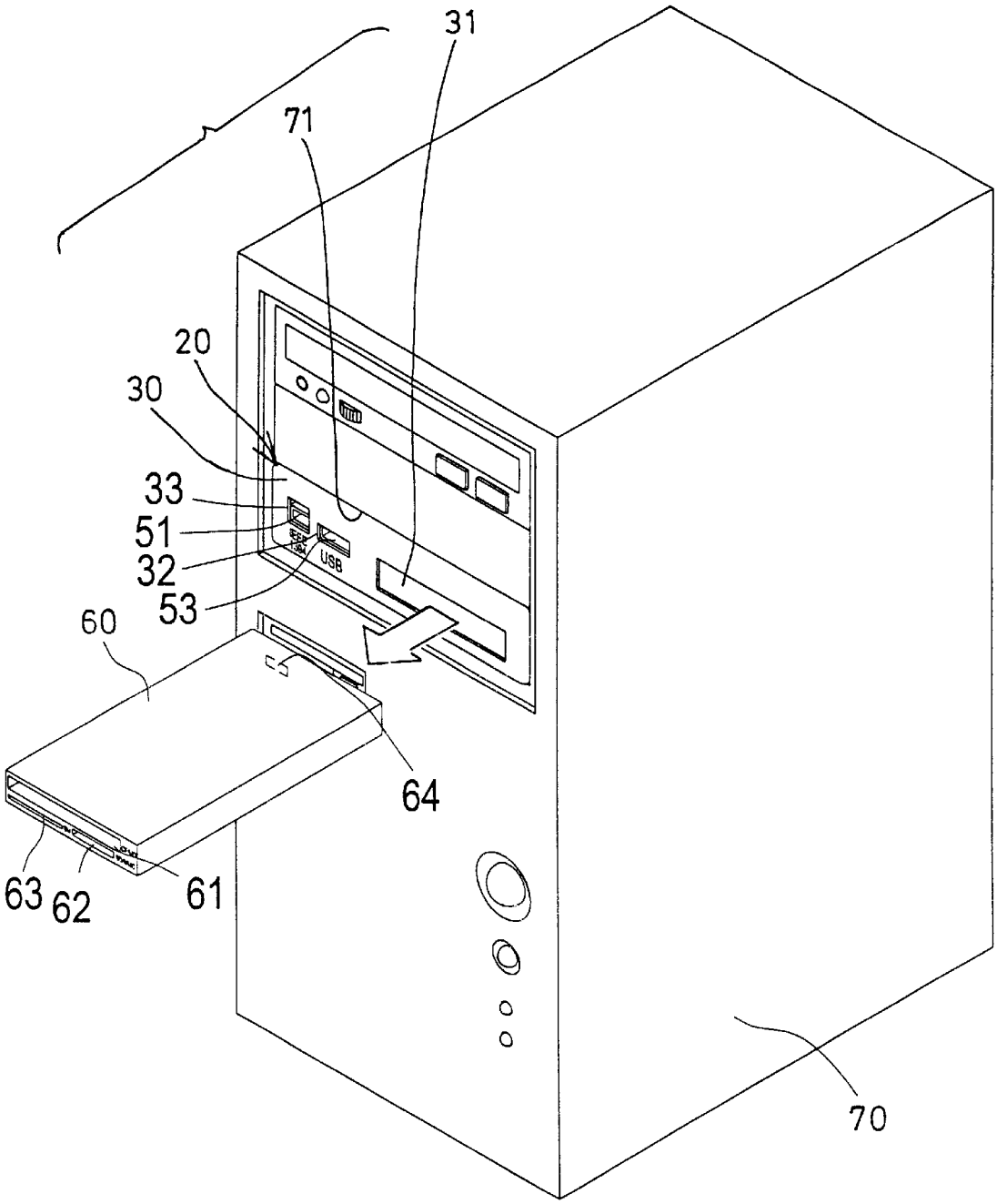
FIG. 4 is a partial exploded view illustrating the attachment or engagement of coupling box to the universal coupler combination.

In operation, the plugs or couplers 52, 54, 57 of the circuit board 50 may be coupled to the corresponding plugs or couplers (not shown) of the computer facility 70 when the housing 20 is plugged into the channel 71 of the computer facility 70 (FIGS. 1, 4). The housing 20, such as the base 21 of the housing 20 may include one or more orifices 24 formed in the rear portion thereof (FIG. 3), for receiving the plugs or couplers 52, 54, 57 and for allowing the plugs or couplers 52, 54, 57 to be coupled to the corresponding plugs or couplers (not shown) of the computer facility 70.

A cap 30 is attached or secured to the front portion of the housing 20, and includes a groove 31 formed therein and aligned with the opening 58 of the circuit board 50, for allowing the coupling box 60 to be engaged into the opening 58 of the circuit board 50 via the groove 31 of the cap 30. The cap 30 further includes one or more apertures 32, 33 formed therein and aligned with the plugs or couplers 53, 51 respectively, for receiving the plugs or couplers 53, 51 respectively, and for allowing the plugs or couplers 53, 51 to be coupled to various kinds of computer facilities or the like.

The coupling box 60 may be engaged into the opening 58 of the circuit board 50 via the groove 31 of the cap 30, and includes a socket or a coupler 64 provided in the rear portion thereof for coupling to the coupler 55 of the circuit board 50, and includes a slot or a socket 61 formed or provided therein for coupling to the compact flash card, the microdrive card, or the like; and/or includes another slot or socket 62 formed or provided therein for coupling to the memory stick card, the secure digital card, the multi-media card, or the like; and/or includes a further slot or socket 63 formed or provided therein for coupling to the smart media card, or the like.

In operation, as shown in FIGS. 1 and 4, the housing 20 may be plugged or engaged into the channel 71 of the computer facility 70, and the coupling box 60 may be plugged into the opening 55 of the circuit board 50 via the groove 31 of the cap 30. Various kinds of cards may be selectively plugged to the slots or sockets 61, 62, 63 of the coupling box 60, and thus may be coupled to the computer facility 70 with only one coupling box 60.

Figure 5:
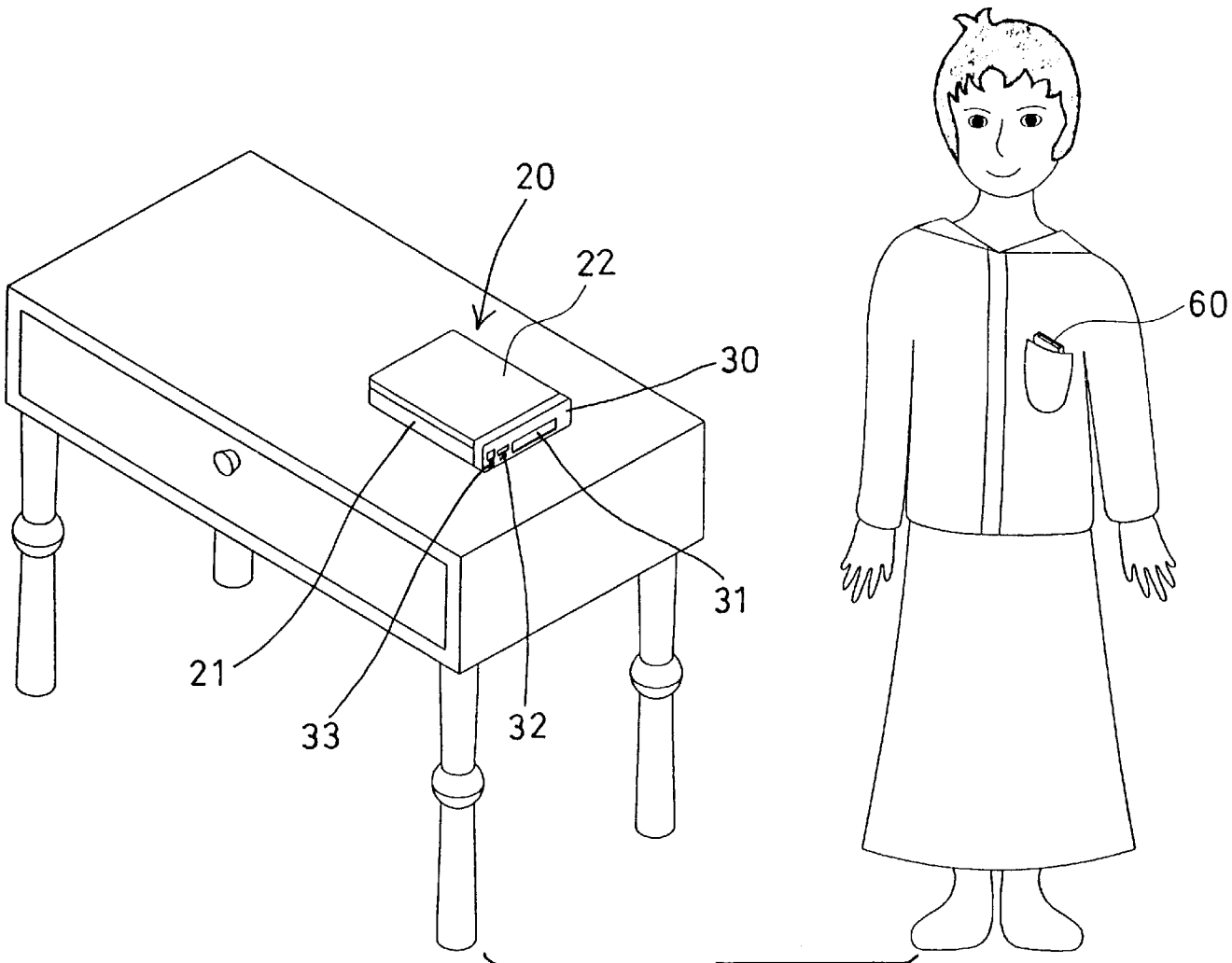
FIG. 5 is a perspective view illustrating the operation of the universal coupler combination.
Figure 6:
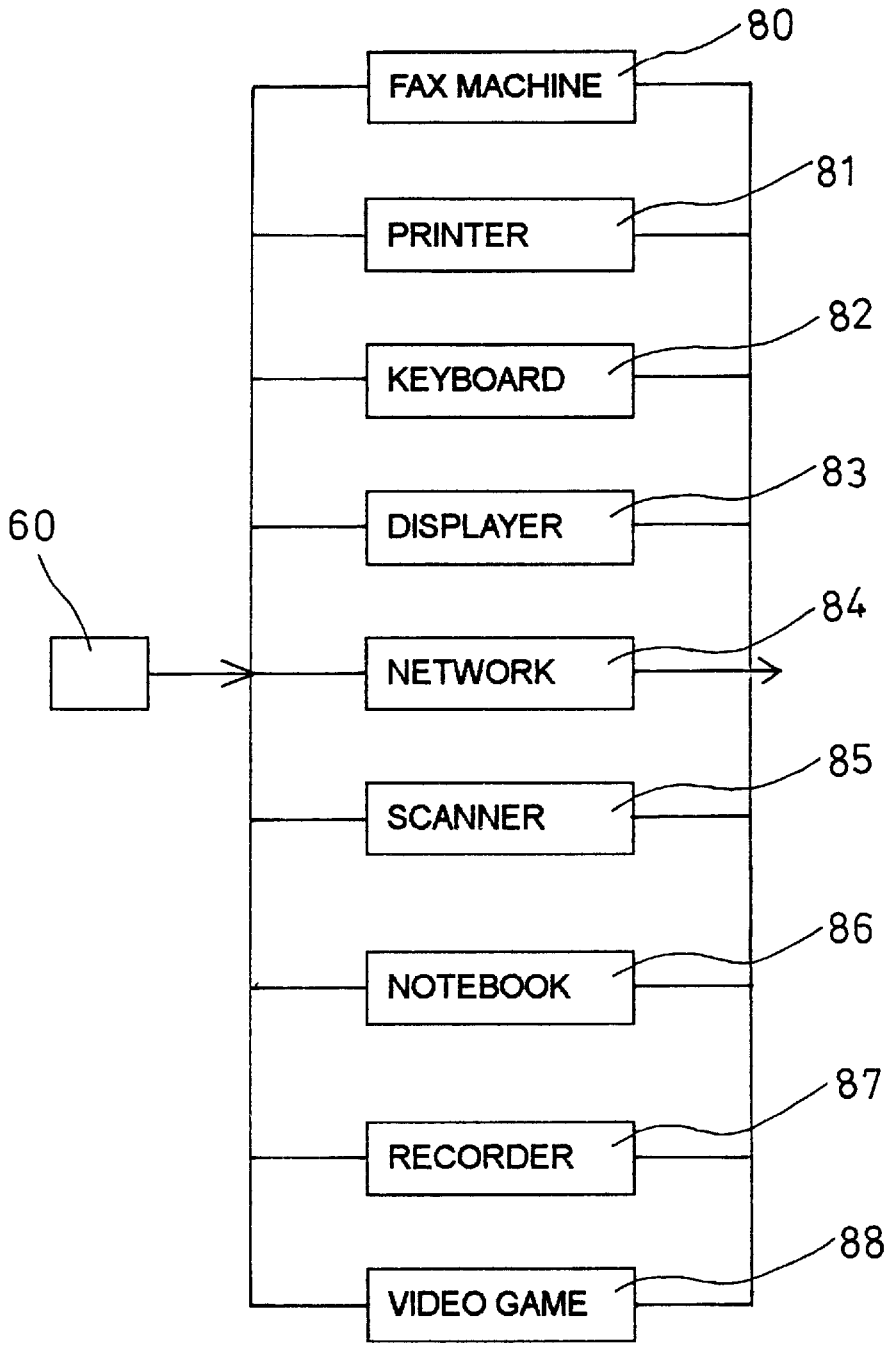
FIG. 6 is a block diagram illustrating the coupling of the universal coupler combination to various kinds of peripheral or output facilities.

As shown in FIG. 5, the coupling box 60 may be detached and disengaged from the housing 20, and may be carried with the users. As shown in FIG. 6, the coupling box 60 may be plugged or coupled to various kinds of peripheral or output facilities, such as the fax machines 80, the printers 81, the keyboards 82, the monitors or the displayers 83, the network machines 84, the scanners 85, the notebook computers 86, the tape recorders 87, the video games 88, or the like.

Accordingly, the universal coupler combination in accordance with the present invention may be used for plugging various kinds of cards, and for allowing various kinds of cards to be coupled to the computer facilities without additional coupling cables, and may be plugged or coupled to various kinds of peripheral or output facilities, or may be plugged or coupled to the other computer facilities or machines.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A universal coupler combination for coupling to a channel of a computer comprising:

a) a housing having:
- i) a base with a plurality of orifices in a rear and an opening in a front; and
- ii) a cover with an opening in a front and connected to the base;

b) a circuit board connected to the base of the housing, the circuit board having:
- i) a first IEEE 1394 coupler connected to a front of the circuit board and aligned with the openings in the base and the cover;
- ii) a second IEEE 1394 coupler connected to a rear of the circuit board and aligned with a first of the plurality of orifices in the base;
- iii) a first USB coupler connected to the front of the circuit board and aligned with the openings in the base and the cover;
- iv) a second USB coupler connected to the rear of the circuit board and aligned with a second of the plurality of orifices in the base;
- v) a fifth coupler connected to the rear of the circuit board and aligned with a third of the plurality of orifices in the base;
- vi) a coupling box plug connected to the front of the circuit board; and
- vii) at least one microprocessor electrically connected to the first and the second IEEE 1394 couplers, the first and the second USB couplers, the fifth coupler, and the coupling box plug; and c) a coupling box having:
- i) a coupling box coupler connected to a rear and removably inserted into the coupling box plug of the circuit board;
- ii) a first socket connected to a front of the coupling box;
- iii) a second socket connected to the front of the coupling box; and
- iv) a third socket connected to the front of the coupling box.

2. The universal coupler according to claim 1, wherein the first socket in the coupling box is selected from the group of sockets for a compact flash card, and a micro drive card.

3. The universal coupler according to claim 1, wherein the second socket in the coupling box is selected from the group of sockets for a memory stick card, a secure digital card, and a multi-media card.

4. The universal coupler according to claim 1, wherein the third socket in the coupling box is for a smart media card.

5. The universal coupler according to claim 1, wherein the fifth coupler has at least one row of pins.

6. The universal coupler according to claim 1, further comprising a cap connected to the openings in the front of the base and the cover, the cap having a groove and a plurality of apertures, the coupling box slidably fit within the groove in the cap, the first IEEE 1394 coupler and the first USB coupler being aligned with a first and a second of the plurality of apertures in the cap respectively, such that when the housing is connected to the channel of the computer the cap is assessable from an exterior of the computer.

7. The universal coupler according to claim 6, further comprising a notch in a front of the circuit board, the notch aligning with the groove in the cap, such that the coupling box is slidably fit within the notch.

* * * * *